US008327950B2

(12) United States Patent
Pollock et al.

(10) Patent No.: US 8,327,950 B2
(45) Date of Patent: Dec. 11, 2012

(54) EXCAVATION APPARATUS

(75) Inventors: Edward Marshall Pollock, Toronto (CA); Andrew Leslie Pollock, Toronto (CA)

(73) Assignee: Utilicor Technologies Inc., Toronto (CA)

( * ) Notice: Subject to any disclaimer, the term of this patent is extended or adjusted under 35 U.S.C. 154(b) by 292 days.

(21) Appl. No.: 12/851,642

(22) Filed: Aug. 6, 2010

(65) Prior Publication Data

US 2012/0031679 A1 Feb. 9, 2012

(51) Int. Cl.
*E02D 7/06* (2006.01)

(52) U.S. Cl. ..... 173/185

(58) Field of Classification Search ..... 37/231–233; 172/23–26.6; 173/24, 45, 26–29, 46, 184–189; 175/162, 20, 323, 210, 211, 213
See application file for complete search history.

(56) References Cited

U.S. PATENT DOCUMENTS

| | | | | |
|---|---|---|---|---|
| 2,856,155 | A | 10/1958 | Putt | |
| 3,089,550 | A | 5/1963 | Watson | |
| 3,525,404 | A | 8/1970 | Newman et al. | |
| 3,527,309 | A | 9/1970 | Rassieur | |
| 3,548,604 | A | 12/1970 | Campbell | |
| 3,754,604 | A | 8/1973 | Inaba et al. | |
| 3,768,578 | A | 10/1973 | Russell, Jr. | |
| 4,610,314 | A | 9/1986 | Gien | |
| 4,645,084 | A | 2/1987 | Deike | |
| 4,809,788 | A | 3/1989 | Nelson | |
| 5,226,488 | A | 7/1993 | Lessard et al. | |
| 5,377,767 | A | 1/1995 | Briggs | |
| 5,421,669 | A | 6/1995 | Bertrand | |
| 5,451,128 | A | 9/1995 | Hattersley | |
| 5,558,169 | A | 9/1996 | Madgwick et al. | |
| 5,662,176 | A | 9/1997 | Madgwick et al. | |
| 6,298,928 | B1 | 10/2001 | Penchansky | |
| 6,533,048 | B2 | 3/2003 | Groce et al. | |
| 6,896,072 | B2 | 5/2005 | MacDonald | |
| 6,907,874 | B1 | 6/2005 | Faircloth | |
| 7,055,630 | B1 | 6/2006 | Burton | |
| 7,128,165 | B2 | 10/2006 | McGivery | |
| 7,134,562 | B2 | 11/2006 | Burkett | |
| 7,575,069 | B2 * | 8/2009 | Pavlik | 175/20 |
| 2003/0007835 | A1 | 1/2003 | Jurshak | |
| 2004/0112613 | A1 | 6/2004 | McGivery | |

FOREIGN PATENT DOCUMENTS

| | | |
|---|---|---|
| WO | 8504918 | 11/1985 |

* cited by examiner

*Primary Examiner* — Robert Pezzuto
(74) *Attorney, Agent, or Firm* — Bereskin & Parr LLP/ S.E.N.C.R.L, s.r.l.

(57) ABSTRACT

An excavation apparatus includes a base structure mountable to a vehicle, and a first supporting member pivotally coupled to the base structure. The first supporting member is pivotable about a pivot axis that is generally parallel to a lateral direction between a retracted position and an advanced position. A second supporting member is rotatably coupled to the first supporting member. A rotary spindle is supported by the second supporting member and extends lengthwise along a cutting axis and is rotatable thereabout for driving a cutting element. When the first supporting member is in the advanced position, the second supporting member is rotatable about a rotation axis that is generally parallel to a longitudinal direction between a stowed position in which the cutting axis is generally parallel to the lateral direction and a deployed position in which the cutting axis is generally parallel to a vertical direction.

20 Claims, 12 Drawing Sheets

EXCAVATION APPARATUS

FIELD

The teaching disclosed herein relates to one or more methods and/or apparatuses for excavating, particularly drilling or coring.

BACKGROUND

U.S. Pat. No. 4,645,084 (Deike) discloses a portable light weight robot arm assembly simulating shoulder, elbow, and wrist movements of a human arm, plus extensions of the upper arm and forearm, accurately positions and holds a power tool for performing driving, drilling, chipping, lifting and the like operations at a work-site. The assembly is self contained having a base easily and quickly mounted on a conventional truck or on the ground at the work-site, a carriage shiftable longitudinally and transversely on the base, an upright pedestal tiltable in all planes relative to the base, an extensible boom or upper arm rotatably and swingably mounted on the pedestal, and an extensible power tool suspension arm or forearm pivoted to the upper arm. Hydraulic jacks control the lowering, raising, and extension of the boom, the tilting of the pedestal, the positioning of the carriage, the extension and positioning of the forearm, and the position of the tool. An hydraulic motor controls the rotation of the pedestal and a hydraulic motor can also operate a winch on the boom. The jacks and motor are selectively activated from a portable station, such as a hand held switch unit, permitting freedom of movement of the operator to best observe the work. The upper arm is swung and tiltable about its shoulder on the pedestal and extended or retracted to position its outer end or elbow. The forearm is suspended on the elbow to position the tool, extended to load the tool, and the tool is held by the wrist end of the forearm in its desired position on the work.

U.S. Pat. No. 7,128,165 (McGivery) discloses a system and method of cutting a core out of a finished surface for keyhole excavation, using a truck with a turret to which a support arm supporting the cutter assembly is mounted, and a stabilizing member remote from the turret, which allows the turret to be rotated about its complete arc of motion while stabilizing the support arm at any desired position about the truck. In a first embodiment the invention comprises an upstanding support rim affixed to or integrated into the bed of the truck. In a further embodiment the invention comprises a support member affixed to the horizontal arm and supported by the truck bed. This is disclosed as making the keyhole excavation procedure safer and more precise, and allowing a larger-depth cutting head to be used in order to penetrate thicker finished surfaces. In the preferred embodiment the cutter head is provided with a pilot which creates a pilot hole in the core that may facilitate removal, manipulation and replacement of the core, and may improve the integrity of the reinstated core.

United States Patent Publication No. 20080277131 (Pollock) discloses an excavation apparatus that includes a support structure mountable to a truck bed, the support structure defining a longitudinal direction extending front-to-back of the truck bed, and a lateral direction extending side-to-side of the truck bed. The apparatus further includes a rotary spindle pivotably supported by the support structure at a first pivot joint defining a generally horizontal first pivot axis, the spindle extending lengthwise along a spindle axis and rotatable thereabout for driving a cutting head; the spindle pivotable about the horizontal first pivot axis between a stowed position wherein the spindle axis is generally horizontal, and a deployed position wherein the spindle axis is generally vertical. The support structure includes a first adjustment device for adjusting the position of the spindle in the longitudinal direction when deployed, and a second adjustment device for adjusting the position of the spindle in the lateral direction when deployed.

SUMMARY

In an aspect of this specification, an excavation apparatus comprises: a base structure mountable to a vehicle, and defining lateral, longitudinal and vertical directions; a first supporting member pivotally coupled to the base structure, and pivotable about a pivot axis that is generally parallel to the lateral direction between a retracted position and an advanced position; a second supporting member rotatably coupled to the first supporting member; and a rotary spindle supported by the second supporting member, the spindle extending lengthwise along a cutting axis and rotatable thereabout for driving a cutting element. When the first supporting member is in the advanced position, the second supporting member is rotatable about a rotation axis that is generally parallel to the longitudinal direction between a stowed position in which the cutting axis is generally parallel to the lateral direction and a deployed position in which the cutting axis is generally parallel to the vertical direction.

In an aspect of this specification, an excavation apparatus comprises: a base structure mountable to a vehicle, and defining lateral, longitudinal and vertical directions; a first supporting member pivotally coupled to the base structure, and pivotable about a pivot axis that is generally parallel to the lateral direction between a retracted position and an advanced position; a second supporting member rotatably coupled to the first supporting member; and a motor coupled to the second supporting member and configured to rotatably drive a cutting element about a cutting axis. When the first supporting member is in the retracted position, the second supporting member is positioned above the base structure, and the first supporting member is arranged vertically intermediate the base structure and the second supporting member. When the first supporting member is in the advanced position, the motor is spaced apart from the base structure in the longitudinal direction and the second supporting member is arranged longitudinally intermediate the base structure and the motor so that the cutting axis is presented away from the vehicle. When the first supporting member is in the advanced position, the second supporting member is rotatable about a rotation axis that is generally parallel to the longitudinal direction between a stowed position in which the cutting axis is generally parallel to the lateral direction and a deployed position in which the cutting axis is generally parallel to the vertical direction.

In an aspect of this specification, a combination includes: a vehicle having a front and a back, and defining a lateral direction extending from side-to-side of the vehicle, a longitudinal direction extending from the front to the back of the vehicle, and a vertical direction; and an excavation apparatus comprising a base structure mounted to the front of the vehicle, a supporting member rotatably coupled to the base structure, and a rotary spindle supported by the second supporting member, the spindle extending lengthwise along a cutting axis and rotatable thereabout for driving a cutting element. The supporting member is rotatable about a rotation axis that is generally parallel to the longitudinal direction between a stowed position in which the cutting axis is generally parallel to the lateral direction and a deployed position in which the cutting axis is generally parallel to the vertical direction.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. In the drawings.

DETAILED DESCRIPTION

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any exclusive right granted by issuance of this patent application. Any invention disclosed in an apparatus or process described below and for which an exclusive right is not granted by issuance of this patent application may be the subject matter of another protective instrument, for example, a continuing patent application, and the applicants, inventors or owners do not intend to abandon, disclaim or dedicate to the public any such invention by its disclosure in this document.

Figure 1:
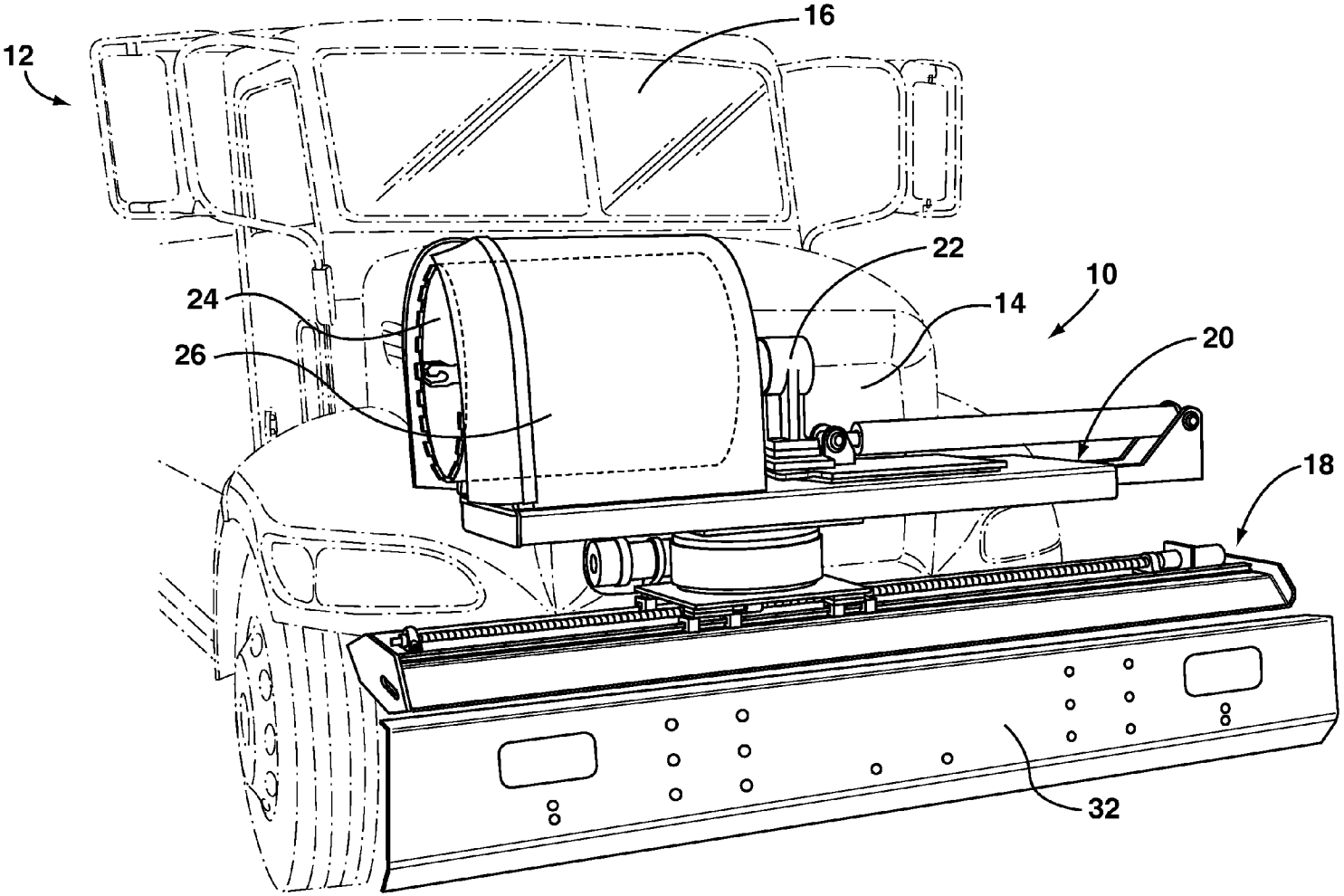
FIG. 1 is a front perspective view of an example of an excavation apparatus.

Referring to FIG. 1, an example of an excavation apparatus is shown generally at 10. The apparatus 10 can be installed to a vehicle 12. As illustrated, the vehicle 12 can be a truck.

The apparatus 10 includes first and second supporting members 18, 20 that are coupled together. The apparatus 10 further includes a motor 22 coupled to and supported by the second supporting member 20. The motor 22 is configured to rotatably drive a cutting element 24. The cutting element 24 can be a coring or drilling bit, of various sizes and configurations. Optionally, the cutting element 24 can be surrounded at least partially by a shielding enclosure 26.

As described below, the first supporting member 18 is pivotable between a retracted position (as shown, for example, in FIG. 1) and an advanced position (as shown, for example, in FIG. 5). The second supporting member 20 is rotatable between a stowed position (as shown, for example, in FIG. 1) and a deployed position (as shown, for example, in FIG. 9). When the second supporting member 20 is in the deployed position, the motor 22 and the cutting element 24 can be used to perform a cutting operation to penetrate the ground.

In the example illustrated, the apparatus 10 is installed to a front 14 of the vehicle 12, and maintained with the first and second supporting members 18, 20 in the retracted and stowed positions, respectively, for transport. In some examples, while the first and second supporting members 18, 20 are in the retracted and stowed positions, respectively, the apparatus 10 lies generally clear of a front windshield 16 of the vehicle 12, which can permit a driver to operate the vehicle 12 with a generally unobstructed view through the front windshield 16.

In some examples, the apparatus 10 can further include a bumper member 32 that is presented generally away from the vehicle 12 to serve as a bumper for the vehicle when the first and second supporting members 18, 20 are in the retracted and stowed positions, respectively. In the example illustrated, the first supporting member 18 and the bumper member 32 each have a linear extent that generally corresponds with a width of the vehicle 12.

Figure 2:
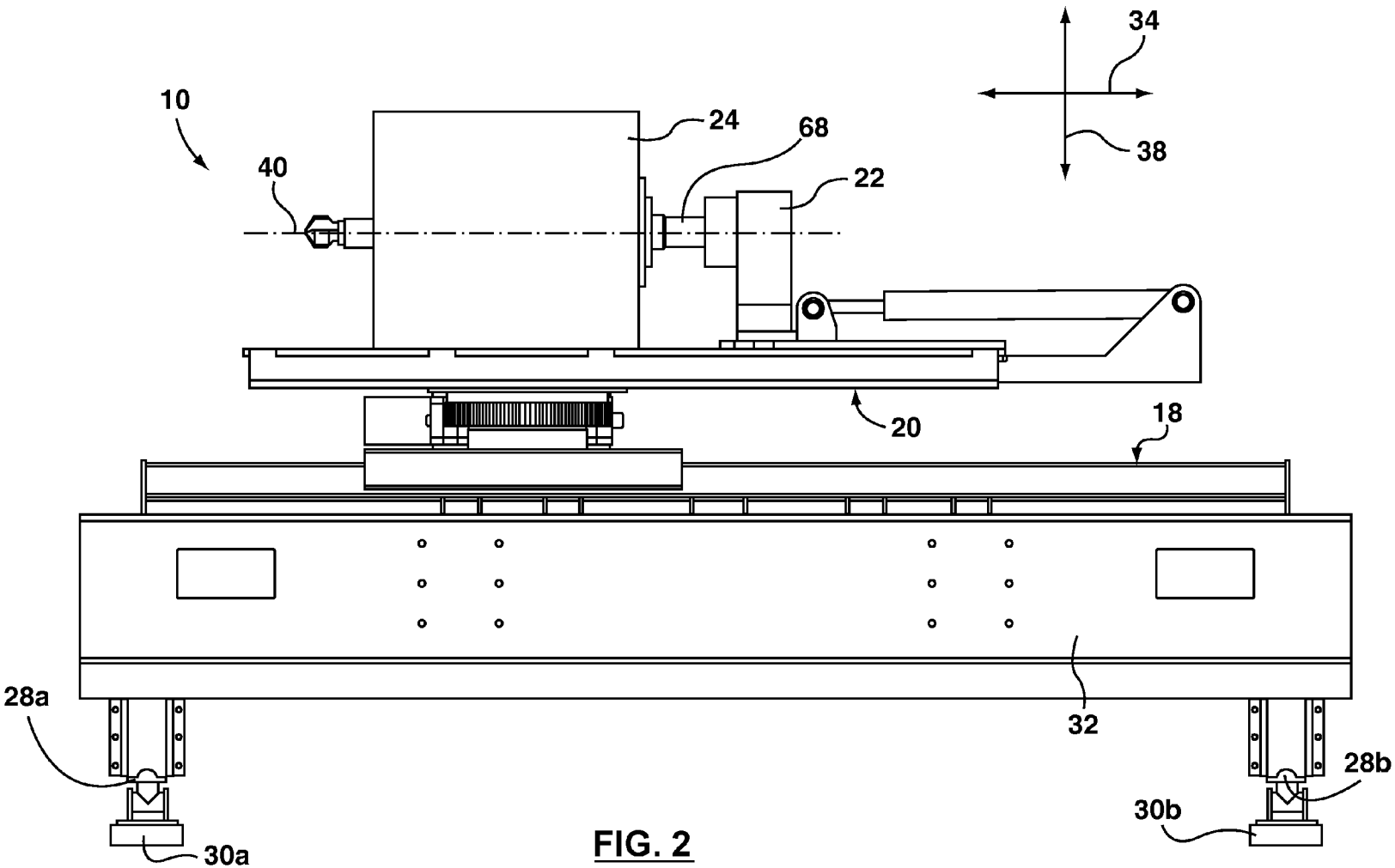
FIGS. 2, 3, 4 are front, side and rear perspective views, respectively, of the apparatus of FIG. 1, shown with a first supporting member in a retracted position.
Figure 3:
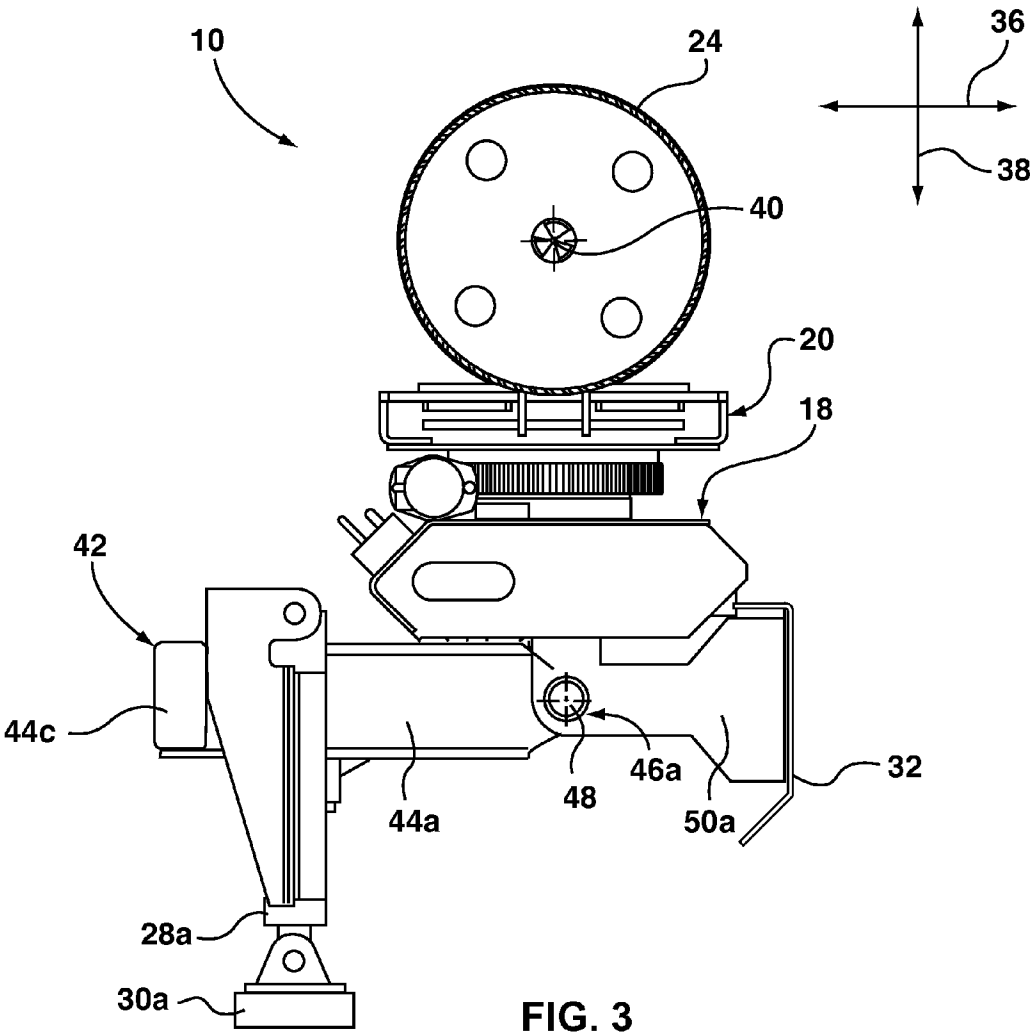

In FIG. 2, the apparatus 10 is shown relative to a lateral direction 34 and a vertical direction 38. In FIG. 3, the apparatus 10 is shown relative to a longitudinal direction 36 and the vertical direction 38. The lateral direction 34, the longitudinal direction 36 and the vertical direction 38 can be mutually orthogonal.

Figure 4:
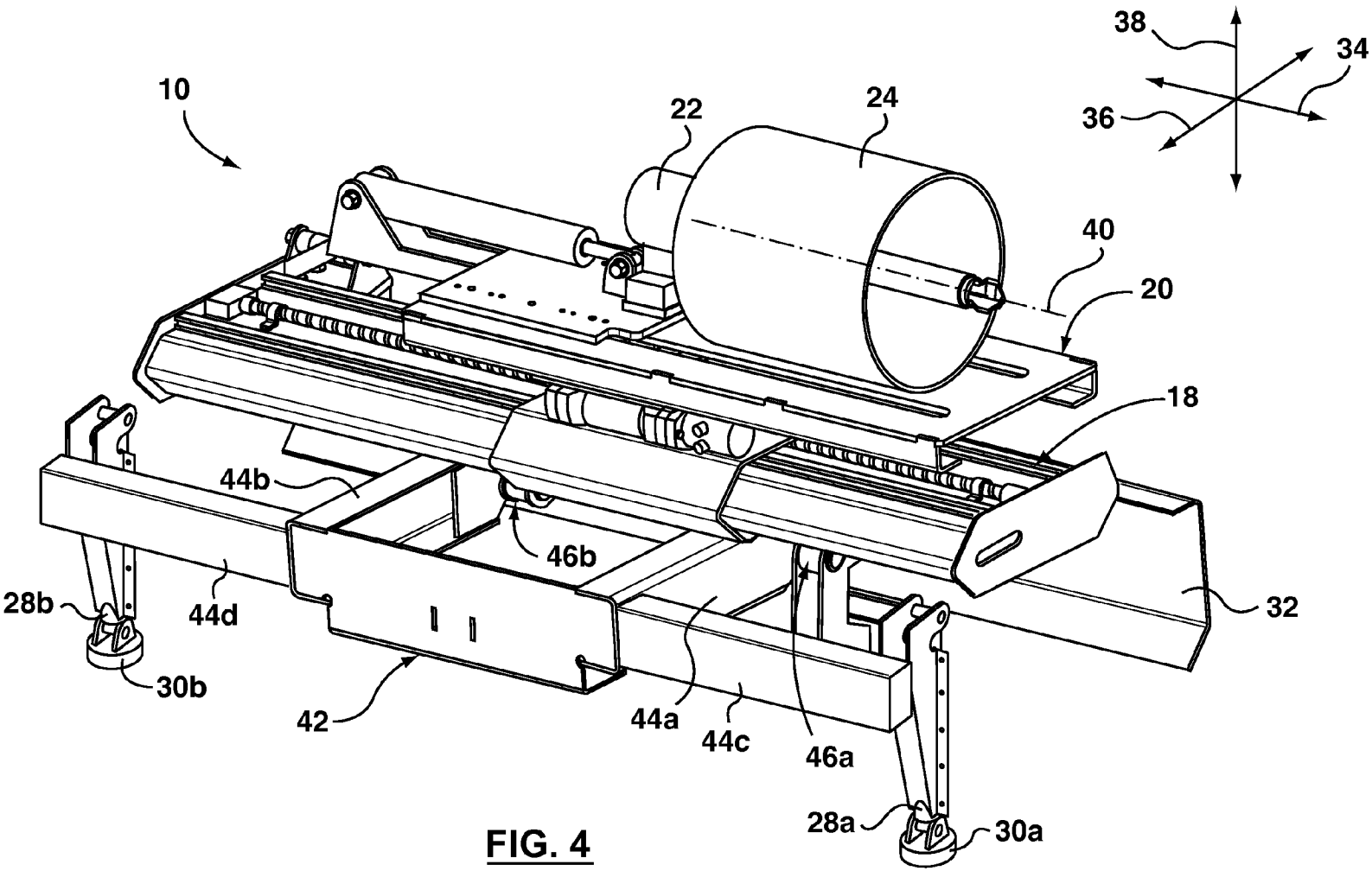
Figure 7:
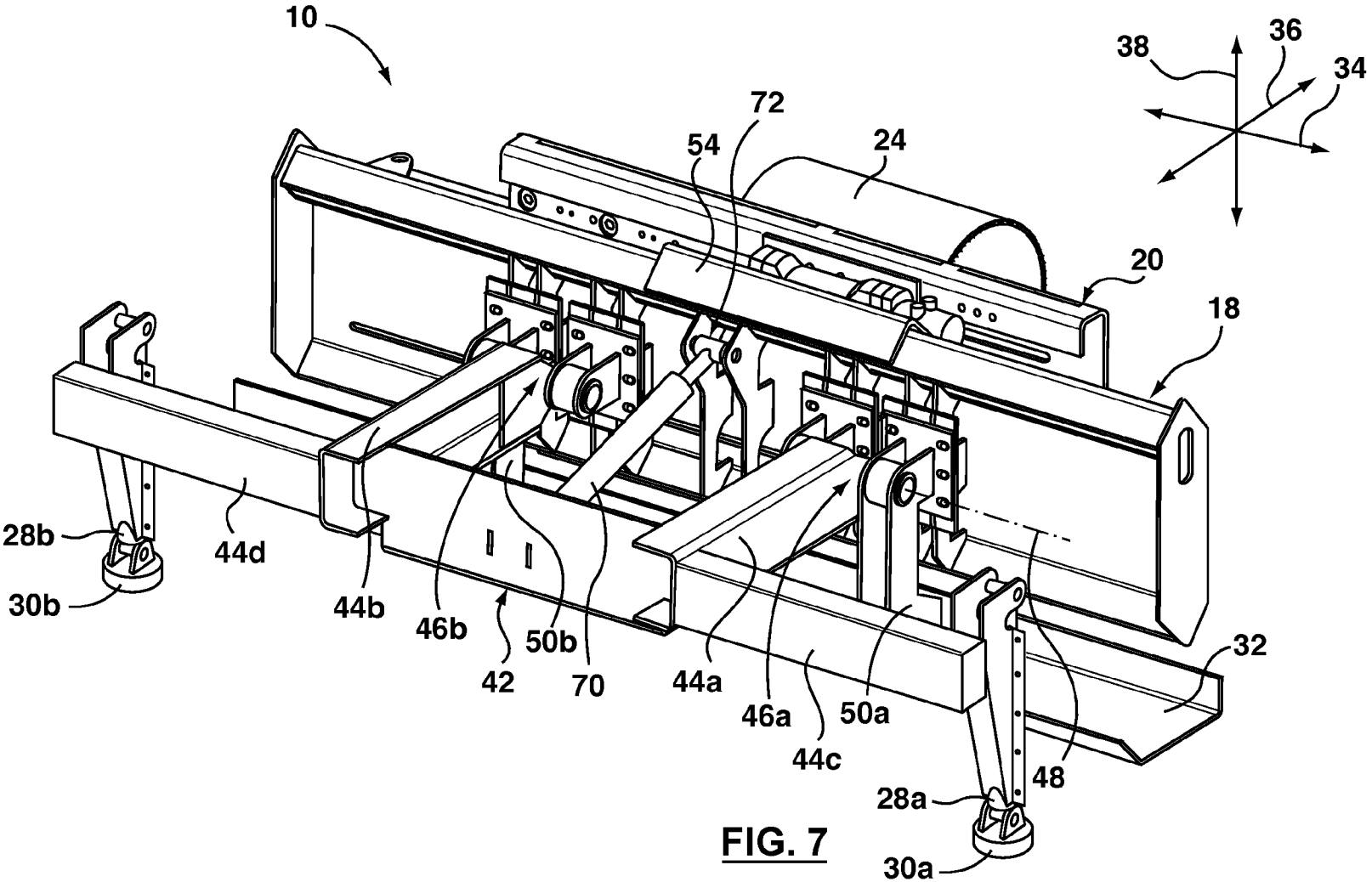

Referring particularly to FIGS. 4 and 7, the apparatus 10 includes a base structure 42 that is mountable to a vehicle. The base structure 42 can be mounted to a vehicle using suitable means, for example but not limited to, bolts or welding.

In the example illustrated, the base structure 42 includes first and second arm portions 44*a*, 44*b* that extend generally in the longitudinal direction 36 and are spaced apart in the lateral direction 34. The arm portions 44*a*, 44*b* have anchoring ends spaced apart from the pivot axis 48 for mounting to the vehicle. The first and second arm portions 44*a*, 44*b* are coupled to the first supporting member 18 at hinge joints 46*a*, 46*b*, respectively. The hinge joints 46*a*, 46*b* define a pivot axis 48 that is generally parallel to the lateral direction 34.

In the example illustrated, the base structure 42 also includes third and fourth arm portions 44*c*, 44*d* fixed adjacent to the anchoring ends of the arm portions 44*a*, 44*b*, respectively. The arm portions 44*c*, 44*d* extend generally in alignment in the lateral direction 34. The apparatus 10 can include stabilizers 28*a*, 28*b* disposed generally at respective opposing ends of the arm portions 44*c*, 44*d*. The stabilizers 28*a*, 28*b* include feet 30*a*, 30*b*, respectively, configured to engage the ground when the apparatus 10 is in use.

Figure 5:
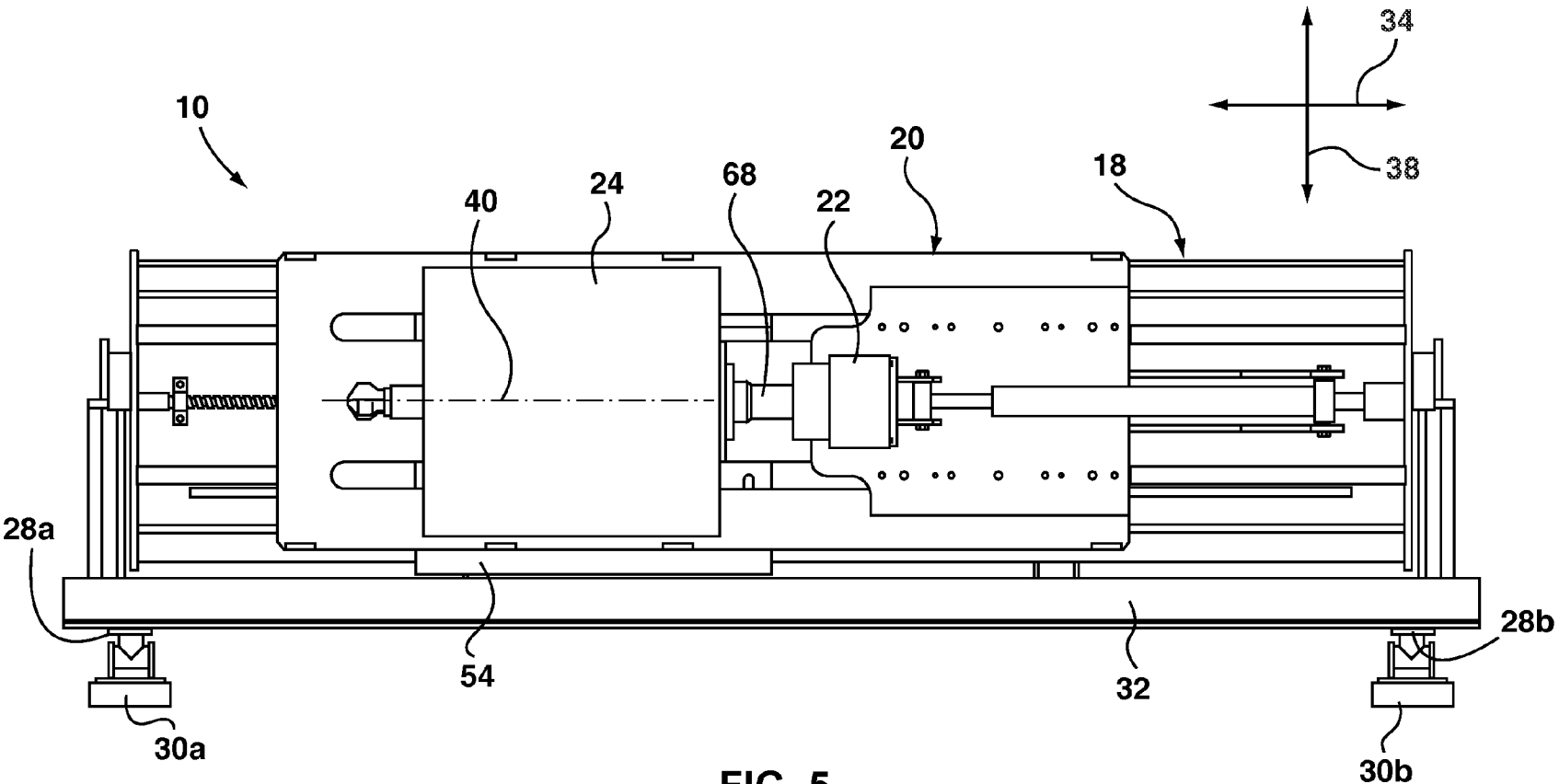
FIGS. 5, 6 and 7 are front, side and rear perspective views, respectively, of the apparatus of FIG. 1, shown with the first supporting member in an advanced position.
Figure 6:
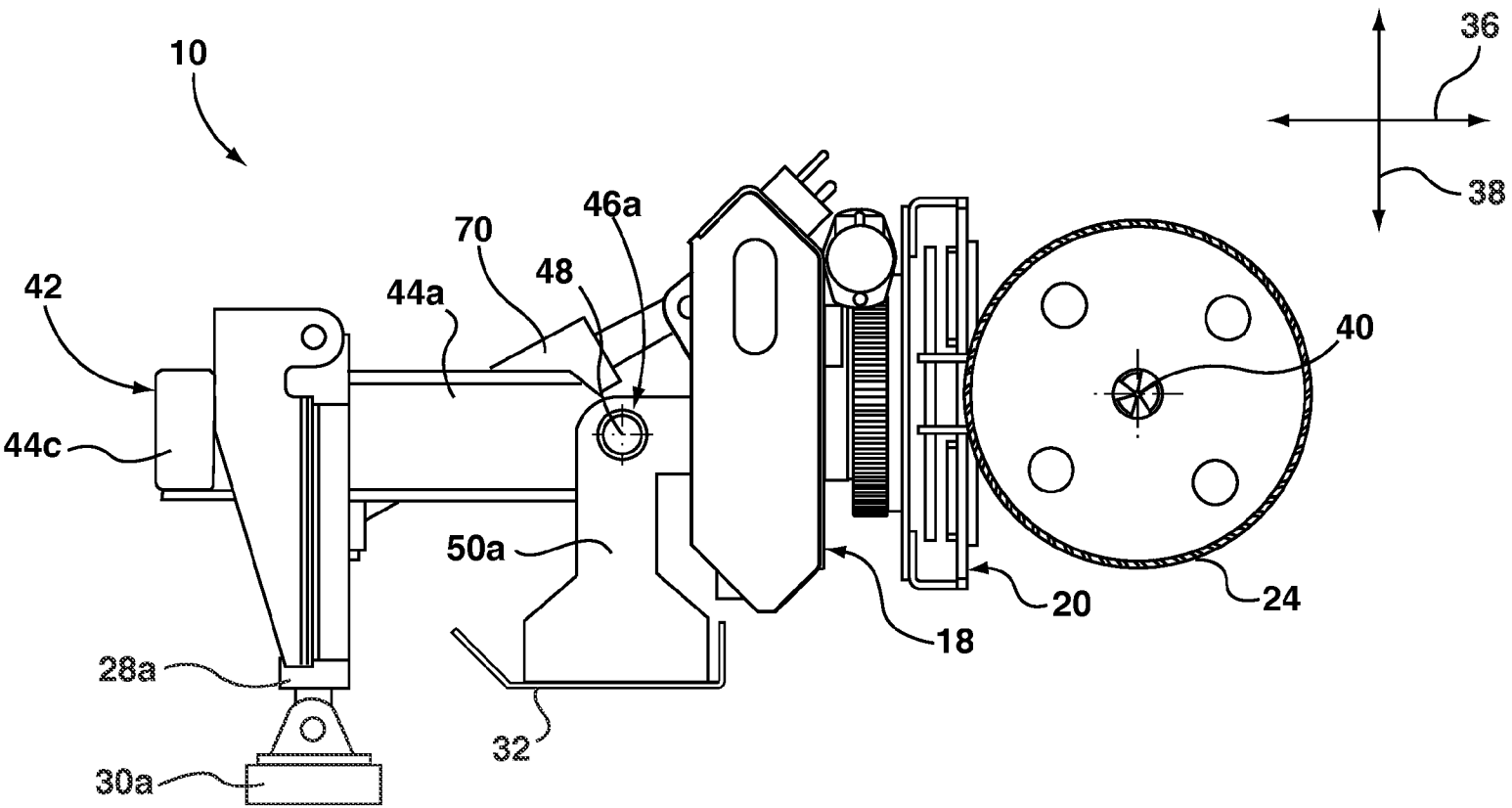

The first supporting member 18 is pivotable about the pivot axis 48 relative to the base structure 42 between a retracted position, shown in FIGS. 2, 3 and 4, and an advanced position, shown in FIGS. 5, 6 and 7.

The apparatus 10 includes a pivot actuator 70 for pivoting the first supporting member 10 about the pivot axis 48 relative to the base structure 42 (see FIGS. 6 and 7). As shown, the pivot actuator 70 can be a hydraulic cylinder, and can be fixed to the first supporting member 18 at hinge joint 72. In other examples, the pivot actuator can be, for example but not limited to, a pneumatic cylinder or an electric motor.

In the example illustrated, the first supporting member 18 is generally elongate and extends lengthwise in a direction that is generally parallel to the lateral direction 34 while in the retracted position (see FIGS. 2, 3 and 4) or in the advanced position (see FIGS. 5, 6 and 7). In the retracted position, the first supporting member 18 can be offset in the vertical direction 38 relative to the base structure 42 so that the first supporting member 18 is nested generally above (as illustrated) or below (not shown) the base structure 42. In the advanced position, the first supporting member 18 can be offset in the longitudinal direction 36 relative to the base structure 42 to present the cutting element 24 away from the vehicle.

The bumper member 32 can be generally elongate and extend lengthwise in a direction that is generally parallel to the lateral direction 34. A generally L-shaped bracket member 50*a* can be mounted between a rear side of the bumper member 32 and the first supporting member 18, and coupled to the first arm portion 44*a* at the hinge joint 46*a*. Similarly, a generally L-shaped bracket member 50*b* can be mounted between the rear side of the bumper member 32 and the first supporting member 18, and coupled to the second arm portion 44*b* at the hinge joint 46*b*.

The first supporting member 18 and the bumper member 32 can be configured to pivot about the pivot axis 48 relative to the base structure 42. Referring to FIGS. 2, 3 and 4, when the first supporting member 18 is in the retracted position, the bumper member 32 is spaced apart from the base structure 42 in the longitudinal direction 36 to serve as a bumper for the vehicle. Referring to FIGS. 5, 6 and 7, when the first supporting member 18 is in the advanced position, the bumper member 32 is positioned below the base structure 42.

The motor 22 is configured to rotatably drive the cutting element 24 about a cutting axis 40. In the example illustrated, a rotary spindle 68 connects the motor 22 and the cutting element 24 and transfers rotational energy and thrust load therebetween. The spindle 68 extends lengthwise along the cutting axis 40 and is rotatable about the cutting axis 40 for driving the cutting element 24.

In the example illustrated, referring particularly to FIGS. 2, 3 and 4, the second supporting member 20 is generally elongate and extends lengthwise in a direction that is generally parallel to the cutting axis 40. The cutting axis 40 is generally parallel to the lateral direction 34 when the second supporting member 20 is in the stowed position.

The second supporting member 20 is rotatably coupled to the first supporting member 18. When the first supporting member 18 is in the retracted position, the second supporting member 20 is spaced apart from the base structure 42 in the vertical direction 38, and the first supporting member 18 is arranged vertically intermediate the base structure 42 and the second supporting member 20. In the example illustrated, the second supporting member 20 is positioned above the base structure 42 when the first supporting member 18 is in the retracted position. Furthermore, when the first supporting member 18 is in the retracted position, the second supporting member 20 can be centrally positioned (both laterally and longitudinally) relative to the first supporting member 18 so as to reside within the plan view extent of the first supporting member 18 when viewed from above.

Referring to FIGS. 5, 6 and 7, when the first supporting member 18 is in the advanced position, the second supporting member 20 is spaced apart from the base structure 42 in the longitudinal direction 36, and the first supporting member 18 is arranged longitudinally intermediate the base structure 42 and the second supporting member 20. The second supporting member is arranged intermediate the first supporting member 18 and the motor 22/spindle 68 so that the cutting axis 40 is presented away from the vehicle.

Figure 8:
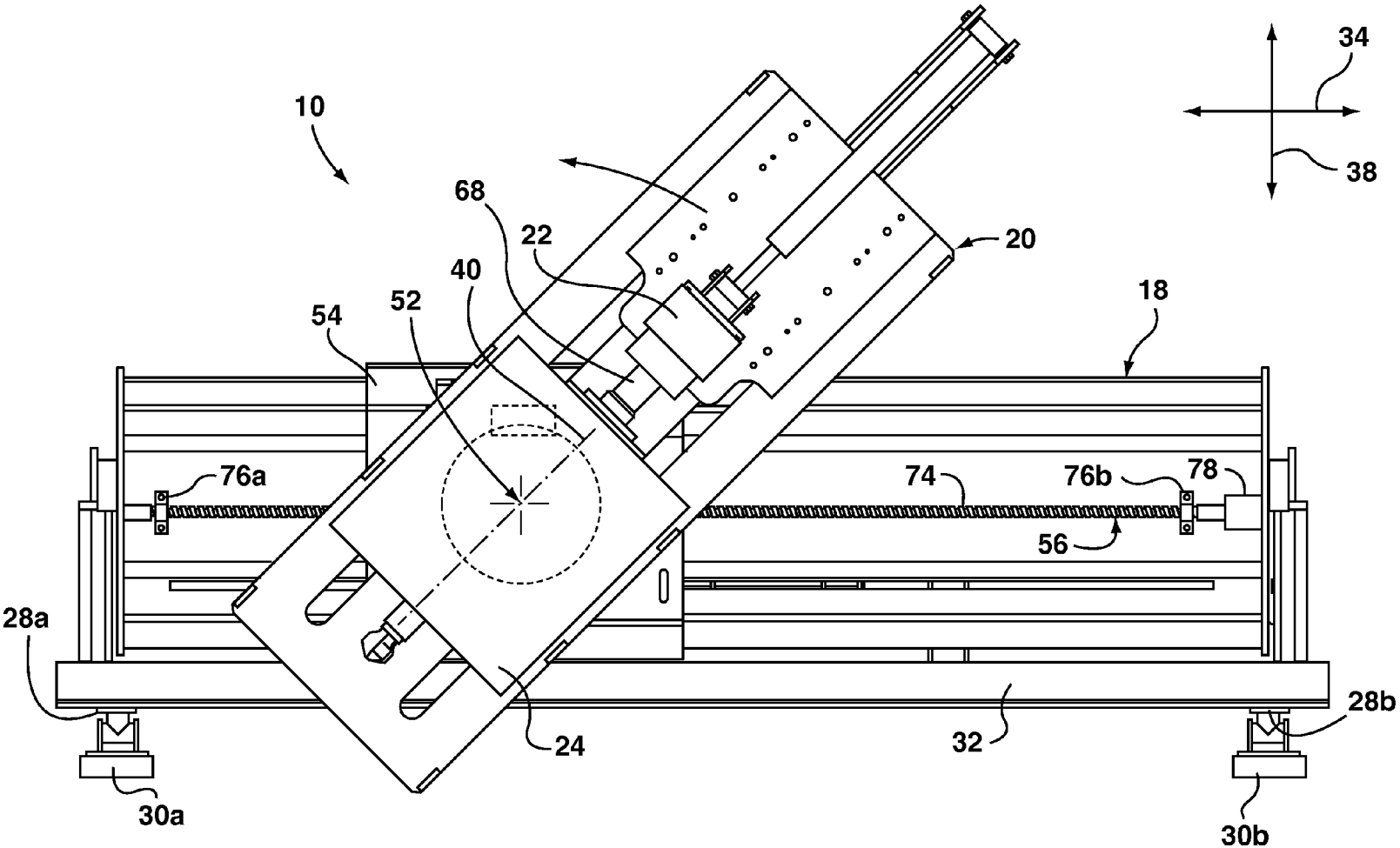
FIG. 8 is a front view of the apparatus of FIG. 1, shown with a second supporting member in an intermediate position.

When the first supporting member 18 is in the advanced position, the second supporting member 20 is rotatable about a rotation axis 52 that is generally parallel to the longitudinal direction 36. The second supporting member 20 is rotatable between a stowed position in which the cutting axis 40 is generally parallel to the lateral direction 36 (see FIGS. 5, 6 and 7) and a deployed position in which the cutting axis 40 is generally parallel to the vertical direction 38 (see FIGS. 9 and 10). FIG. 8 depicts the second supporting member 20 in an intermediate position between the stowed and deployed positions.

In some examples, the second supporting member 20 is configured to translate relative to the first supporting member 18 to adjust the positioning of the cutting axis 40 in the lateral direction 36. As illustrated, with reference to FIGS. 5, 6, 8 and 9, the apparatus 10 can further include a carriage 54 coupling the first and second supporting members 18, 20. In the example illustrated, the second supporting member 20 is mounted to the carriage 54 and the carriage 54 is slidably coupled to the first supporting member 18. An outer profile of the first supporting member 18 can define a track, and an inner profile of the carriage 54 can slidably engage the track. In the example illustrated, the outer surface of the first supporting member 18 and the inner surface of the carriage 54 can have generally complementary polygonal configurations as viewed in a side view cross-section. Furthermore, referring particularly to FIG. 5, the first supporting member 18 can have an elongate cross section with a greater dimension in the vertical direction 38 when in the advanced position, which can facilitate a relatively rigid configuration for supporting the moment of force created by the second supporting member 20, the motor 22, the spindle 68, and the cutting element 24, when the first supporting member 18 is in the advanced position.

Figure 9:
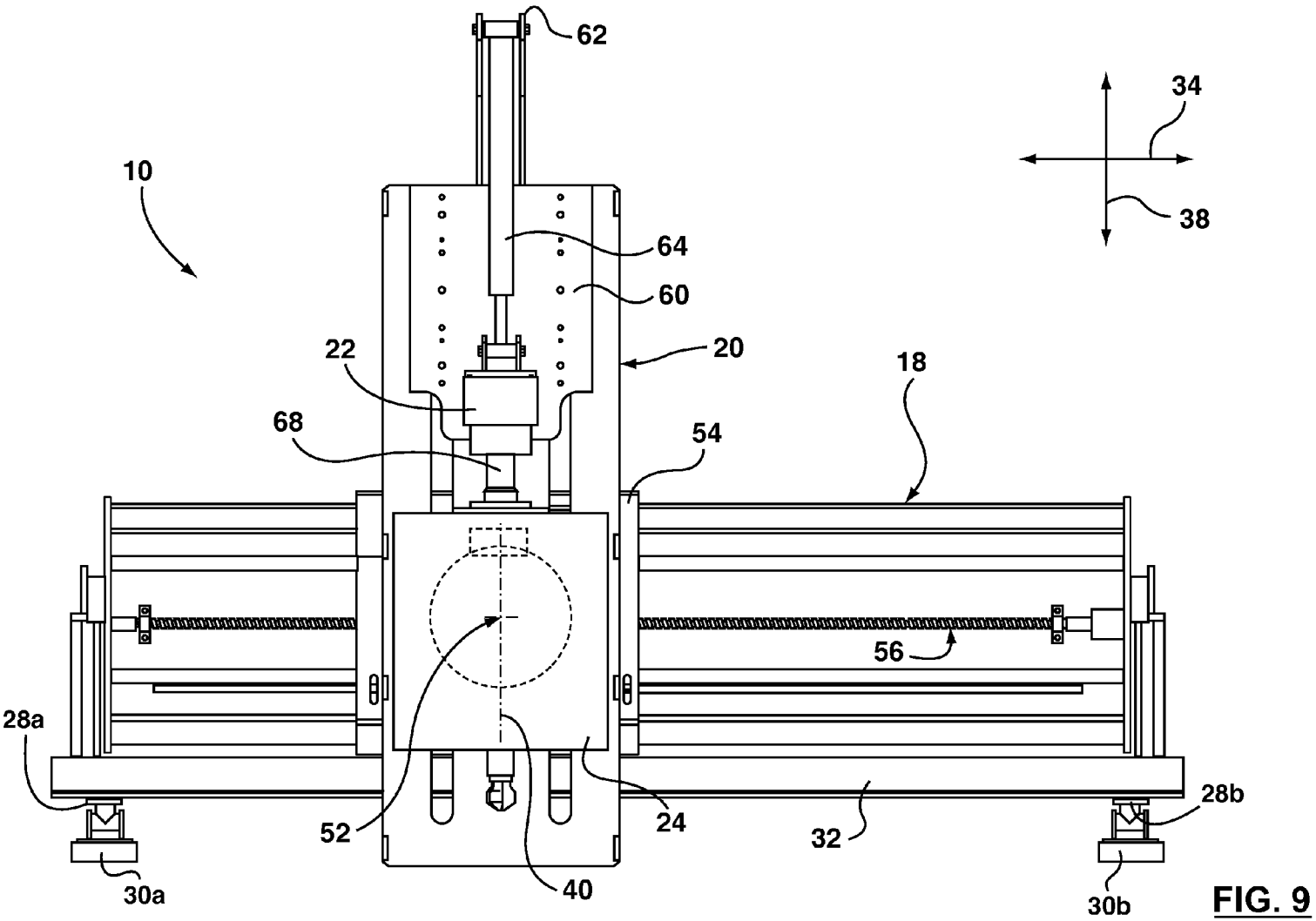
FIGS. 9 and 10 are front and side views, respectively, of the apparatus of FIG. 1, shown with the second supporting member in a deployed position.

In some examples, as illustrated in FIGS. 8 and 9, the apparatus 10 can include a linear actuator which can comprise a ball screw mechanism 56. The ball screw mechanism 56 is mounted to the first supporting member 18 and is configured to move the carriage 54 linearly in the lateral direction 36 relative to the first supporting member 18. Referring particularly to FIG. 8, the ball screw mechanism 56 can include a ball screw 74, bushings 76*a*, 76*b* fixing the ball screw 74 to the first supporting member, a motor 78 to rotate the ball screw 74, and a ball nut (not shown) fixed to the second supporting member 18.

Figure 10:
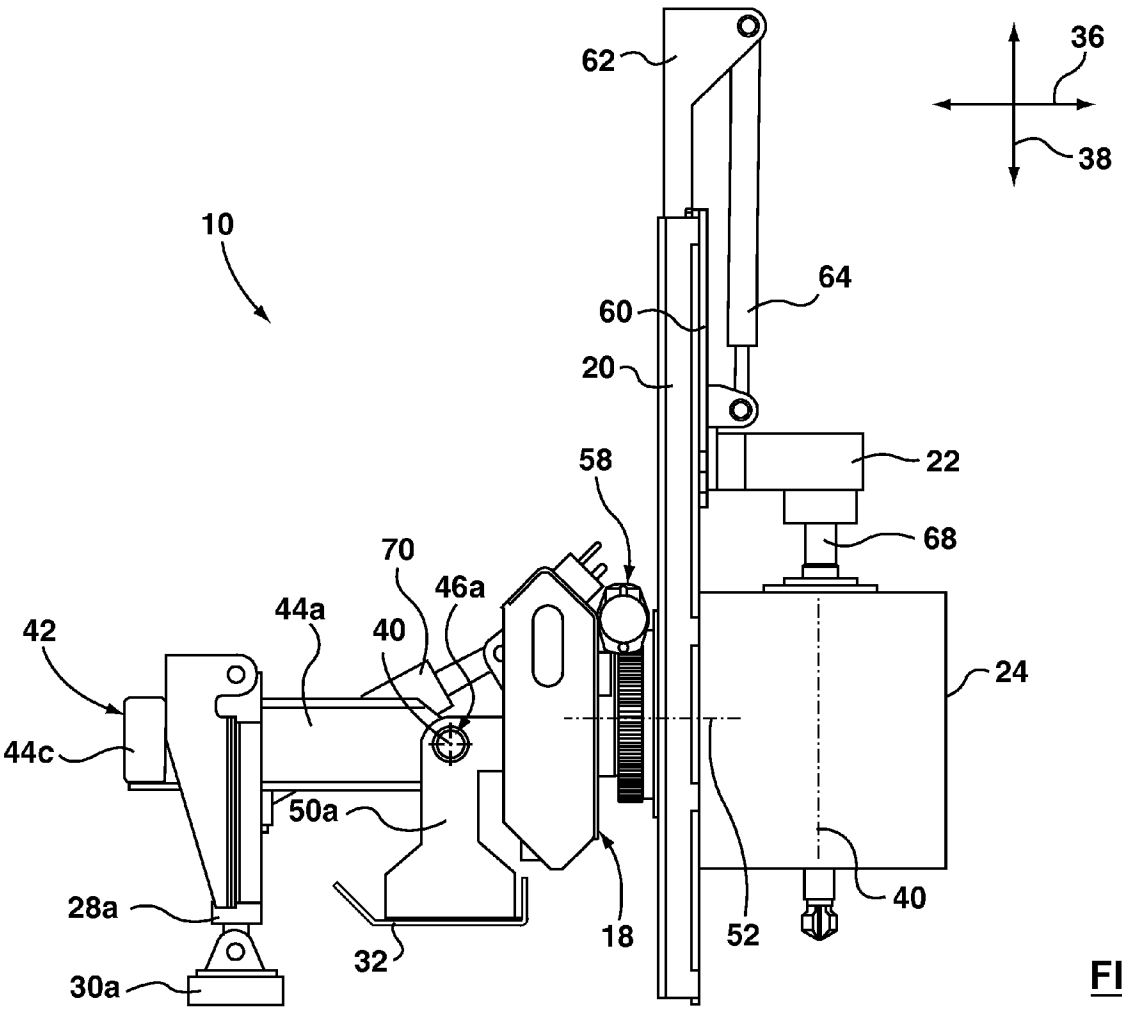

In some examples, as illustrated in FIG. 10, the apparatus 10 can include a rotational actuator which can comprise a worm gear mechanism 58. The worm gear mechanism 58 couples the first and second supporting members 18, 20 and is configured to effect rotation of the second supporting member 20 relative to the first supporting member 18 between the stowed and deployed positions. The worm gear mechanism 58 can include a gear plate coupled to one of the first and second supporting members 18, 20, and a gear motor configured to rotate the gear plate and coupled to the other of the first and second supporting members 18, 20.

In some examples, the motor 22 can be slidably coupled to the second supporting member 20 so that the motor 22 can be moved generally parallel to the cutting axis 40. As illustrated in FIGS. 9 and 10, the apparatus 10 can include a mounting plate 60 that couples the motor 22 to the second supporting member 20. The mounting plate 60 is configured to slide or otherwise move lengthwise along the second supporting member 20 in a direction generally parallel to the cutting axis 40. The mounting plate 60 is connected to an upper end 62 of the second supporting member by an actuator 64. The actuator 64 is configured to translate the motor 22 and mounting plate 60 together in a direction generally parallel to the cutting axis 40.

In use, a vehicle with the apparatus 10 with the first and second supporting members 18, 20 in the retracted and stowed positions, respectively, can be driven into an approximate target position at an excavation site. The excavation site can have, for example, a buried plant (such as a valve or joint) to which access is required. The first supporting member 18 can be moved into the advanced position by pivoting the first supporting member 18 outwardly to present the cutting axis 40 generally away from the vehicle. The feet 30*a*, 30*b* of the stabilizers 28*a*, 28*b* can be lowered to engage the ground and securely support the apparatus 10 over the target position. Next, the second supporting member 20 can be moved from the stowed position into the deployed position by rotating the second supporting member 20 relative to the first supporting member 20 approximately ninety degrees until the cutting axis 40 is generally vertical.

Figure 11:
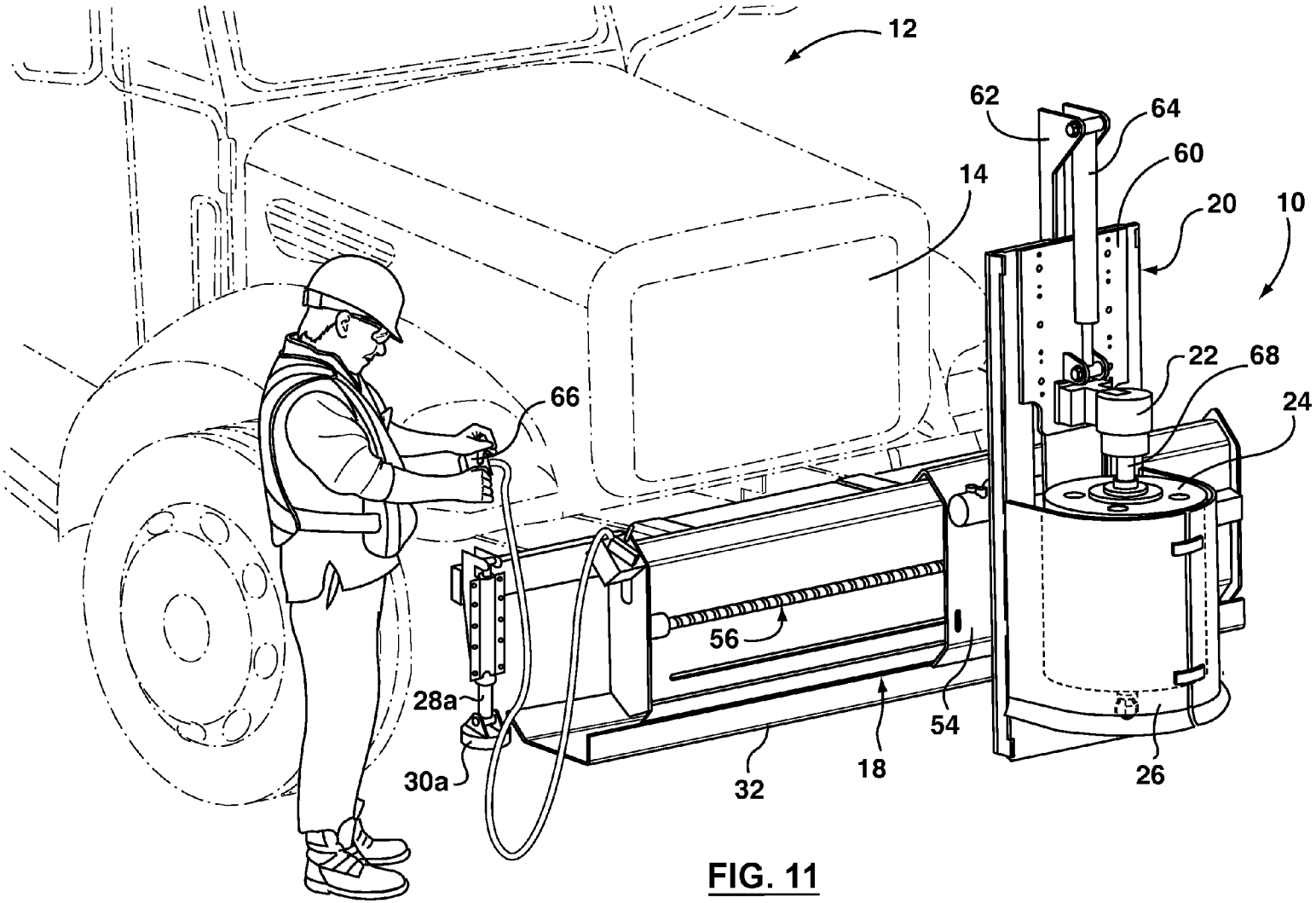
FIGS. 11 and 12 are front perspective views of the apparatus of FIG. 1, shown in use.
Figure 12:
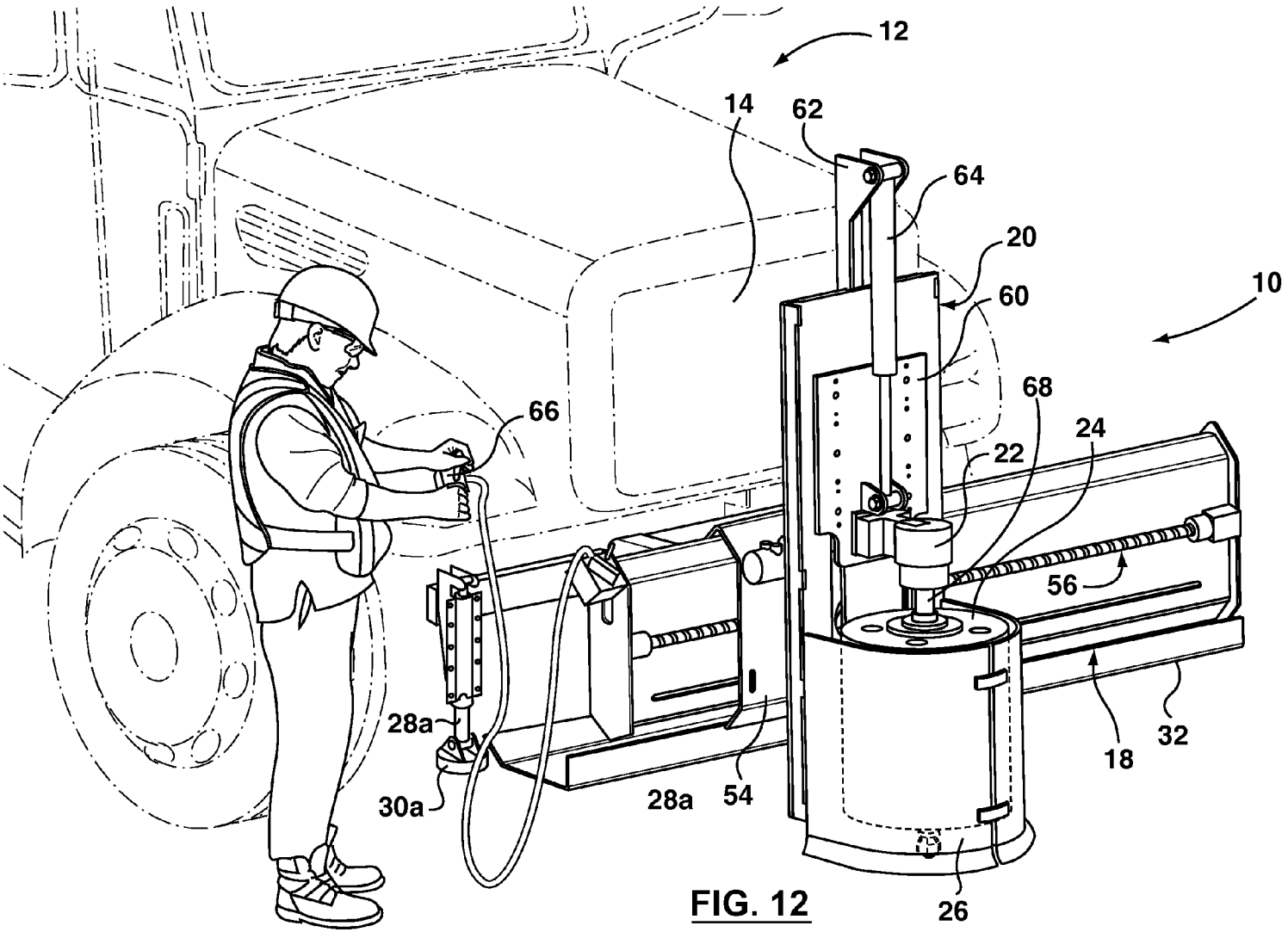

Referring to FIGS. 11 and 12, once the cutting axis 40 is oriented generally vertically, the position of the cutting element 24 can be compared to the target position. The position of the cutting element 24 can be adjusted laterally by displacing the carriage 54 left or right using the ball screw mechanism 56. The position of the cutting element 24 can be adjusted vertically by displacing the slide 60 up or down using the actuator 64.

Once the cutting element 24 is accurately located in a desired position above the target, the motor 22 can then be initiated to drive the rotating spindle 68 and the cutting element 24, which can be lowered by displacing the slide 60 downwards using the actuator 64. The cutting element 24 can used to cut a cylindrical hole, for example 18 inches in diameter. Once a desired cutting depth is reached, the cutting element 24 can be raised by displacing the slide 60 upwards using the actuator 64. Then, the second supporting member 20 can be rotated approximately ninety degrees back to the stowed position, and the first supporting member 18 can be pivoted back to the retracted position. The vehicle can then be driven to another excavation site.

In some examples, a controller 66 allows an operator to centrally control cutting operation of the apparatus 10 by controlling the motor 22, the stabilizers 28*a*, 28*b*, the ball screw mechanism 56, the worm gear mechanism 58, and the pivot actuator 70.

It should be appreciated that the apparatus 10 can include various electrical cables, hydraulic/pneumatic lines and other power connections for controlling the motor 22, the stabilizers 28*a*, 28*b*, the ball screw mechanism 56, the worm gear mechanism 58, the pivot actuator 70, and/or other components, which have been omitted from the drawings for the purposes of clarity.

While the above description provides examples of one or more processes or apparatuses, it will be appreciated that other processes or apparatuses may be within the scope of the accompanying claims.

We claim:

1. An excavation apparatus, comprising:

a) a base structure mountable to a vehicle, and defining lateral, longitudinal and vertical directions;

b) a first supporting member pivotally coupled to the base structure, and pivotable about a pivot axis that is generally parallel to the lateral direction between a retracted position and an advanced position;

c) a second supporting member rotatably coupled to the first supporting member; and d) a rotary spindle supported by the second supporting member, the spindle extending lengthwise along a cutting axis and rotatable thereabout for driving a cutting element, wherein, when the first supporting member is in the advanced position, the second supporting member is rotatable about a rotation axis that is generally parallel to the longitudinal direction, and the second supporting member is rotatable between a stowed position in which the cutting axis is generally parallel to the lateral direction and a deployed position in which the cutting axis is generally parallel to the vertical direction.

2. The apparatus of claim 1, wherein, when the first supporting member is in the retracted position, the second supporting member is spaced apart from the base structure in the vertical direction, and the first supporting member is arranged vertically intermediate the base structure and the second supporting member.

3. The apparatus of claim 2, wherein, when the first supporting member is in the retracted position, the second supporting member is positioned above the base structure.

4. The apparatus of claim 3, wherein, when the first supporting member is in the advanced position, the second supporting member is spaced apart from the base structure in the longitudinal direction, and the first supporting member is arranged longitudinally intermediate the base structure and the second supporting member.

5. The apparatus of claim 4, wherein, when the first supporting member is in the advanced position, the second supporting member is arranged longitudinally intermediate the base structure and the spindle so that the cutting axis is presented away from the vehicle.

6. The apparatus of claim 3, further comprising a generally elongate bumper member connected to the first supporting member and extending lengthwise in a direction that is generally parallel to the lateral direction, the first supporting member and the bumper member configured to pivot relative to the base structure so that, when the first supporting member is in the advanced position, the bumper member is positioned below the base structure, and, when the first supporting member is in the retracted position, the bumper member is spaced apart from the base structure in the longitudinal direction to serve as a bumper for the vehicle.

7. The apparatus of claim 6, wherein the first supporting member and the bumper member pivot about the pivot axis.

8. The apparatus of claim 1, wherein the first supporting member is generally elongate and extends lengthwise in a direction that is generally parallel to the lateral direction.

9. The apparatus of claim 8, wherein the second supporting member is configured to translate along the first supporting member.

10. The apparatus of claim 9, further comprising a carriage coupling the first and second supporting members, the carriage configured to slide along the first supporting member.

11. The apparatus of claim 10, further comprising a linear actuator configured to move the second supporting member in the lateral direction relative to the first supporting member.

12. The apparatus of claim 1, further comprising a worm gear mechanism configured to rotate the second supporting member relative to the first supporting member between the stowed and deployed positions.

13. The apparatus of claim 12, wherein the worm gear mechanism comprises a gear plate coupled to one of the first and second supporting members, and a gear motor coupled to the other of the first and second supporting members, the gear motor configured to rotate the gear plate.

14. The apparatus of claim 1, wherein the second supporting member is generally elongate and extends lengthwise in a direction that is generally parallel to the cutting axis.

15. The apparatus of claim 14, further comprising a motor coupled to the second supporting member, the motor configured to rotatably drive the spindle about the cutting axis.

16. The apparatus of claim 15, wherein the spindle and the motor are configured to move relative to the first supporting member generally parallel to the cutting axis.

17. The apparatus of claim 16, further comprising a mounting plate coupling the motor to the second supporting member, the mounting plate configured to move lengthwise along the second supporting member, the mounting plate connected to the second supporting member by an actuator that is configured to translate the motor generally in a direction parallel to the cutting axis.

18. In combination, the apparatus of claim 1 and a vehicle, wherein the base structure is mounted to a front of the vehicle, and, when the second supporting member is in the deployed position, the cutting axis is arranged within a lateral extent of the front of the vehicle.

19. An excavation apparatus, comprising:

a) a base structure mountable to a vehicle, and defining lateral, longitudinal and vertical directions;

b) a first supporting member pivotally coupled to the base structure, and pivotable about a pivot axis that is generally parallel to the lateral direction between a retracted position and an advanced position;

c) a second supporting member rotatably coupled to the first supporting member; and d) a motor coupled to the second supporting member and configured to rotatably drive a cutting element about a cutting axis, wherein, when the first supporting member is in the retracted position, the second supporting member is positioned above the base structure, and the first supporting member is arranged vertically intermediate the base structure and the second supporting member, wherein, when the first supporting member is in the advanced position, the motor is spaced apart from the base structure in the longitudinal direction and the second supporting member is arranged longitudinally intermediate the base structure and the motor so that the cutting axis is presented away from the vehicle, and wherein, when the first supporting member is in the advanced position, the second supporting member is rotatable about a rotation axis that is generally parallel to the longitudinal direction, and the second supporting member is rotatable between a stowed position in which the cutting axis is generally parallel to the lateral direction and a deployed position in which the cutting axis is generally parallel to the vertical direction.

20. In combination:

a) a vehicle having a front and a back, and defining a lateral direction extending from side-to-side of the vehicle, a longitudinal direction extending from the front to the back of the vehicle, and a vertical direction; and b) an excavation apparatus comprising i) a base structure mounted to the front of the vehicle, ii) a supporting member rotatably coupled to the base structure, and iii) a rotary spindle supported by the supporting member, the spindle extending lengthwise along a cutting axis and rotatable thereabout for driving a cutting element, wherein the supporting member is rotatable about a rotation axis that is generally parallel to the longitudinal direction, and the supporting member is rotatable between a stowed position in which the cutting axis is generally parallel to the lateral direction and a deployed position in which the cutting axis is generally parallel to the vertical direction, and wherein, when the supporting member is in the deployed position, the cutting axis is arranged within a lateral extent of the front of the vehicle.

* * * * *